US006434802B1

(12) United States Patent
Pannone

(10) Patent No.: US 6,434,802 B1
(45) Date of Patent: Aug. 20, 2002

(54) BUTTON REPLACEMENT DEVICE

(76) Inventor: Robert E. Pannone, 177 Patterson Ave., Stratford, CT (US) 06614

( * ) Notice: Subject to any disclaimer, the term of this patent is extended or adjusted under 35 U.S.C. 154(b) by 0 days.

(21) Appl. No.: 09/553,506

(22) Filed: Apr. 20, 2000

(51) Int. Cl.[7] ..... A44B 18/00; A44B 21/00
(52) U.S. Cl. ..... 24/306; 24/304; 2/128
(58) Field of Search ..... 24/304, 306; 2/265, 2/266, 235, 920, 128, 141.1

(56) References Cited

U.S. PATENT DOCUMENTS 3,135,820 A * 6/1964 Hallett, Jr. et al. ..... 24/306 X
3,405,408 A * 10/1968 Baker ..... 24/306 X
4,554,710 A * 11/1985 Grant ..... 24/304 X
4,648,137 A 3/1987 Cooper
4,825,472 A * 5/1989 Garafano ..... 2/128 X
5,048,160 A 9/1991 Goodrich et al.
5,655,268 A 8/1997 Keyaki et al.
5,894,640 A * 4/1999 Dewey ..... 24/306
6,205,623 B1 * 3/2001 Shepart et al. ..... 24/306 X

* cited by examiner

*Primary Examiner*—Robert J. Sandy
(74) *Attorney, Agent, or Firm*—Bachman & LaPointe, P.C.

(57) ABSTRACT

The present invention relates to a securing or button replacement device which includes a base member having an attachment side and a fastening side and a connecting member secured to the base member. The connecting member is sized to fit through a hole in a first piece of material to be joined to a second piece of material or a first part of a garment to be joined to a second part of a garment. After a free end of the connecting portion is passed through the hole, the connecting member is looped on itself so that the free end can be brought into engagement with a plurality of engagement members on the fastening side of the base member.

26 Claims, 1 Drawing Sheet

BUTTON REPLACEMENT DEVICE

BACKGROUND OF THE INVENTION

The present invention relates to a device for replacing lost or broken buttons commonly used to attach two pieces of fabric or other materials and a method of using same. The device of the present invention has particular use in the replacement of lost or broken buttons on garments such as shirts, jackets, coats, pants, and the like.

Perhaps the earliest form of attachment for clothing involved the use of a button sewed or otherwise attached to an edge of the fabric, which is oriented in alignment with a button hole positioned at an opposing fabric location. This button/button hole form of attachment has been applied to virtually every form of clothing, as well as many non-clothing items.

Often, buttons become damaged or lost as a result of cleaning the clothing to which they are affixed or a result of wear. Additionally, the threads used to hold the buttons on the clothing becomes damaged and broken during use. Thus, there has been, and there remains, a need to replace broken or lost buttons.

A number of button replacement devices are known in the art. U.S. Pat. No. 5,048,160 to Goodrich et al. illustrates one such device. The device is actually a device for converting a button/button hole attachment combination in a shirt, blouse, or the like to a pressure contact system which avoids the need of manipulating a small button through a small button hole. The device includes a first sheet of flexible material having an exposed side and an attachment side, where the attachment side includes adhesive means for attachment to a button location on the shirt or blouse. A second sheet of flexible material, including an exposed side and an attachment side, includes a button coupled at its attachment side to facilitate positioning at a button hole corresponding to the button location means for the first sheet of material and located on the shirt or blouse. The respective exposed sides of the first and second sheets of material include hook/loop attachment means which are capable of being joined on contact and separated by merely pulling the respective pieces apart.

U.S. Pat. No. 5,655,268 to Keyaki also relates to a button substitute fastening device. The device comprises a generally C-cross-section support body molded of thermoplastic synthetic resin and having substantially parallel first and second plates integrally joined at their one ends by a connecting portion; a multiplicity of engaging elements standing upright on an outer surface of the second plate and adapted for engagement with engaging elements of the companion surface fastener member; the first plate having on its outer surface an arbitrary ornamental design; and a pull-up tab integrally projecting outwardly from the connector in parallel to the first and second plates.

U.S. Pat. No. 4,647,137 to Cooper illustrates a shirt construction having an adjustable collar opening. The shirt has first and second strips of material secured to the neck band beneath the collar on opposite sides of the frontal opening. A third strip of material is pivotally attached to the first strip and has a surface of a hook or a pile type material, the first and second strips being of the other type. The size and arrangement of the strips is such that the third strip may be superposed with and releasably adhered to the opposing surface of the first strip, concealed beneath the collar when the latter is worn in the open condition, or turned 180 degrees about its pivotal mounting to extend across the frontal opening and adhered to the opposing surface of the second strip to close the frontal opening in the collar area at a desired width between a predetermined maximum and minimum. The collar fold defining the neck opening is preferably higher than the portion of the neck band between the collar wings so that a necktie may be worn with the upper edge of the knot somewhat below the collar fold without exposing the neck band.

Despite the existence of these button replacement devices, there remains a need for other button replacement devices which are compact, easy to store, and easy to use.

SUMMARY OF THE INVENTION

Accordingly, it is an object of the present invention to provide a button replacement or securing device which can be used to secure pieces of clothing or other items together.

It is a further object of the present invention to provide a button replacement or securing device as above which is inexpensive and does not require much effort to use.

It is yet another object of the present invention to provide a method of replacing a button which is easy to perform.

The foregoing objects are attained by the button replacement or securing device and the method of the present invention.

In accordance with the present invention, a device for securing two parts of a garment together where a first part of said garment contains a button hole comprises a base member having an attachment side and a fastening side and a connecting member secured to the base member. The connecting member is sized to fit through the button hole in the first part, while the base member is adapted to be attached to a second part of the garment. A free end of the connecting member passes through the button hole and is attached to the base member so as to form a loop which holds the first part of the garment to the second part of the garment. As can be seen from the foregoing description, the securing device of the present invention has particular utility as a button replacement device.

A method for replacing a button in accordance with the present invention comprises the steps of providing a button replacement device comprising a base member and a connecting member joined to the base member; attaching the base member to a first piece of material; passing the connecting member through a hole in a second piece of material; and affixing a free end portion of the connecting member to the base member so as to secure the second piece of material to the first piece of material.

The present invention also relates to a button replacement kit comprising a plurality of button replacement devices. Each of the button replacement devices comprises a base member and a connecting member joined to the base member. Each base member has an adhesive layer and a removable cover positioned over the adhesive layer. Each connecting member is sized to pass through a button hole.

Other details of the device, the method, and the kit of the present invention, as well as other objects and advantages attendant thereto, are described in the following detailed description and the accompanying drawings wherein like reference numerals depict like elements.

DETAILED DESCRIPTION OF THE PREFERRED EMBODIMENT(S)

Figure 1:
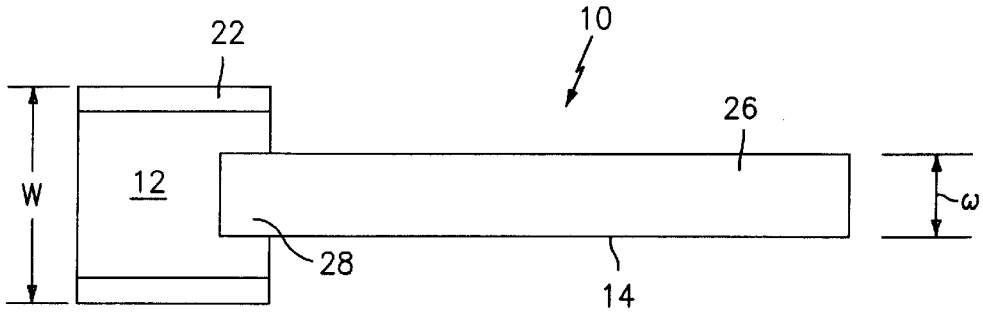
FIG. 1 is a top view of a button replacement device in accordance with the present invention.
Figure 5:
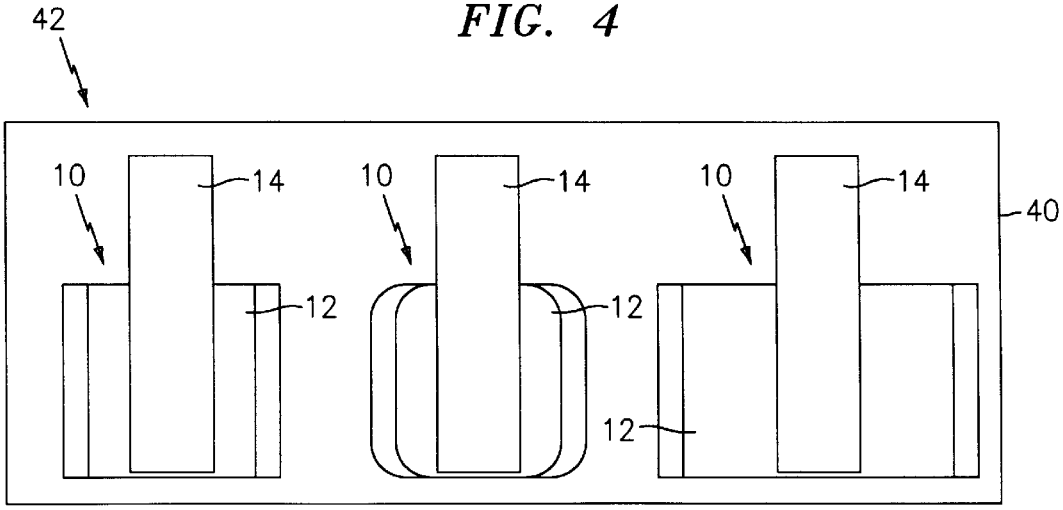
FIG. 5 is a perspective view of a kit containing the button replacement devices of the present invention.

Referring now to the drawings, FIG. 1 illustrates a button replacement device 10 in accordance with the present invention. The device 10 includes a base member 12 and a connecting member 14 affixed to the base member 12. The base member 12 may be made out of any suitable material known in the art and may have any desired configuration. For example, the base member 10 can have any desired polygonal shape, such as a square shape, a rectangular shape, or a triangular shape. Alternatively, the base member 10 can have a circular shape as shown in FIG. 5.

Figure 2:
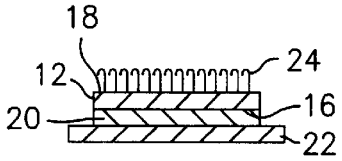
FIG. 2 is a sectional view of the base member portion of the button replacement device of FIG. 1.

Referring now to FIG. 2, the base member 10 has an attachment side 16 and a fastening side 18. The attachment side 16 is at least partially covered with a layer 20 of adhesive material. The layer 20 of adhesive material may comprise a layer of any suitable adhesive material known in the art having sufficient adhesive properties to affix the base member 10 to a piece of a garment, a piece of fabric, or any other material. A removable cover 22 is provided over the adhesive material layer 20 to prevent inadvertent adherence of the device 10 on an unwanted area. The cover 22 may be formed from any suitable pliable material known in the art such as paper.

The fastening side 18 of the base member is provided with a plurality of members 24 for engaging a free end portion 26 of the connecting member 14. The engagement members 24 may comprise a portion of a hook and loop contact system. For example, the members 24 may comprise a plurality of hook shaped fasteners. If desired, the engagement members 24 may be formed from a piece of VELCRO material attached to the fastening side 18 of the base member 12.

The connecting member 14 may be joined to the base member in any suitable manner known in the art. For example, an end 28 of the connecting member 14 may be adhesively affixed to the base member 12. Such a configuration would allow the connecting member 14 to be separated from the base member 12 to facilitate storage of the device. Preferably, the connecting member 14 is integrally formed with the base member 12.

Figure 3:
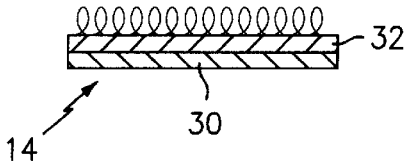
FIG. 3 is a sectional view of the connecting member portion of the button replacement device of FIG. 2.

Referring now to FIG. 3, the connecting member 14 may have two layers 30 and 32. The layer 30 preferably comprises a backing layer and may be formed from any suitable material known in the art, such as a nylon material. The layer 32 preferably comprises a layer of fabric attached to the backing layer 30 via any suitable material known in the art. The layer 32 may be formed from a VELCRO material or alternatively from a piece of fabric material, such as a felt material. The material forming layer 32 must be such that it adheres to the hook/loop fastening system present on the fastening side 18 of the base member.

As can be seen from FIG. 1, the connecting member 14 has a width w which is sized to allow the free end portion 26 of the connecting member 14 to pass through a hole 34, such as a button hole, in a piece of fabric. The base member 12 has a width W that is greater than the width w of the connecting member. In a preferred embodiment of the present invention, the connecting member 14 has a length L that is greater than the largest dimension of the base member 12.

Figure 4:
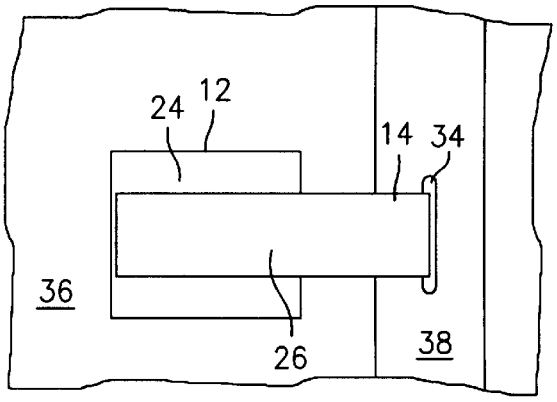
FIG. 4 is a perspective view of the button replacement device of the present invention in use.

Referring now to FIG. 4, the button replacement device 10 of the present invention may be used to secure first and second fabric pieces 36 and 38 together. The fabric pieces 36 and 38 may form two parts of a garment, such as a shirt, coat, pants, etc., or they may be two pieces of material which need to be joined or fastened together, such as a pocketbook and its flap. As shown in FIG. 4, the cover 22 is removed from the attachment side 16 of the base member 12 and the base member 12 is adhered to a surface of the first fabric piece 36 by placing the base member 12 in a desired location and pressing the base member against the fabric piece 36. The base member 12 must be positioned so that the connecting member 14 is aligned with a hole 34 in the fabric piece 38. The free end portion 26 of the connecting member 14 is then passed through the hole 34, such as a button hole, and looped over itself so that the free end portion 26 is placed into contact with the engagement members 24 on the fastening side 18 of the base member 12. To release the two pieces of fabric 36 and 38, the free end portion 26 is removed from its engagement with the engagement members 24 and is withdrawn through the hole 34.

As can be seen from the foregoing description, the securing or button replacement device of the present invention is easy to use. It requires no needle or thread. Further, it may be used to replace a wide variety of buttons on a wide variety of items such as coats, jackets, shirts, pants, etc. It may also be used to replace buttons on non-apparel items such as a button used to close a pocketbook or some other container. The securing or button replacement device of the present invention is versatile in that the loop formed with the connecting member can have a wide variety of lengths which allows the securing or button replacement device of the present invention to be used in a wide variety of settings.

Still further, the securing or button replacement device of the present invention is advantageous in that it is relatively inexpensive to produce. Also, the securing or button replacement device of the present invention may be used so that the base member 12 is substantially concealed beneath one piece of fabric while the connecting member has its free end joined to a relatively small exposed portion of the fastening side 18.

The button replacement or securing device of the present invention is compact. As a result, a plurality of the devices 10 may be stored and sold in a container 40 as a kit 42 as shown in FIG. 5. The availability of such a kit allows a user to easily replace a plurality of buttons on a garment or a non-garment item or to replace a plurality of buttons on a number of different garments or items. The kit 42 is of a size that it can easily travel with the user.

After a lost or damaged button has been replaced, the device 10 may be removed from the garment or other item and returned to its storage container 40 for re-use at a later time.

It is apparent that there has been provided in accordance with the present invention a button replacement device which fully satisfies the objects, means, and advantages set forth hereinbefore. While the present invention has been described in the context of specific embodiments thereof, other variations, alternatives and modifications will become apparent to those skilled in the art after reading the present disclosure. Therefore, it is intended to embrace such variations, alternatives and modifications as fall within the broad scope of the appended claims.

What is claimed is:

1. A device for securing two parts of a garment together where a first part of said garment contains a button hole, said device comprising:

a base member having an attachment side and a fastening side, said base member being secured to a second part of said garment; and a connecting member secured to said base member, said connecting member being fitted through said button hole in said first part.

2. The device according to claim 1, wherein said fastening side of said base member has a plurality of engagement members for engaging an end portion of said connecting member after said end portion of said connecting member has been passed through said button hole so as to form said connecting member into a loop.

3. The device according to claim 2, wherein said connecting member comprises a piece of fabric material for mating with at least some of said plurality of engagement members.

4. The device according to claim 3, wherein said connecting member further has a backing layer applied to said piece of fabric material.

5. The device according to claim 2, wherein said engagement members comprise a plurality of hook shaped fastening members.

6. The device according to claim 1, wherein said attachment side of said base member includes a layer of adhesive for securing said base member to said second part of said garment.

7. The device according to claim 1, wherein said base member has a width greater than the width of said connecting member and said connecting member has a length greater than the largest dimension of said base member.

8. The device according to claim 1, wherein said connecting member is integrally formed with said base member.

9. The device according to claim 1, wherein said connecting member is separable from said base member.

10. The device according to claim 1, wherein said connecting member is adhered to said base member.

11. The device according to claim 1, wherein said base member is round.

12. The device according to claim 1, wherein said base member has a polygonal shape.

13. A device for securing a first piece of material to a second piece of material, said device comprising:

a base member secured to said first piece of material;

said base member including an adhesive layer on a first surface and a removable cover placed over said adhesive layer; and a connecting member attached to said base member and passing through a hole in said second piece of material.

14. A device according to claim 13, wherein said base member has a plurality of engagement members on a second surface for engaging an end portion of said connecting member after said end portion has been passed through said hole.

15. A device according to claim 14, wherein said engagement members comprises hook and loop contact members and said connecting member has mating hook and loop contact members on at least one of its surfaces for engaging at least some of said hook and loop contact members on said base member.

16. A button replacement device comprising:

a base member adhesively secured to a first portion of a garment;

a connecting member fixedly connected to said base member; and said connecting member passing through a button hole in a second portion of said garment and forming a loop for joining said second portion of said garment to said first portion of said garment when an end portion of said connecting member engages said base member.

17. A method for replacing a button comprising:

providing a button replacement device comprising a base member and a connecting member joined to said base member;

attaching said base member to a first piece of material;

passing said connecting member through a hole in a second piece of material; and affixing a free end portion of said connecting member to said base member so as to secure said second piece of material to said first piece of material.

18. A method according to claim 17, wherein said attaching step comprises attaching said base member to a first part of a garment and said passing step comprises passing said connecting member through a button hole in a second part of said garment.

19. A method according to claim 17, wherein said attaching step comprises adhesively mounting said base member to said first piece of material.

20. A method according to claim 17, wherein said attaching step comprises positioning said base member in a desired location on said first piece of material and applying a pressure force to said base member to secure said base member to said first piece of material.

21. A method according to claim 17, wherein said affixing step comprises using a hook/loop system to join said free end to said base member.

22. A method according to claim 17, further comprising exposing a layer of adhesive material on said base member prior to said attaching step.

23. A method according to claim 22, wherein said exposing step comprises removing a pliable cover positioned over said layer of adhesive material from said base member.

24. A button replacement kit comprising:

a plurality of button replacement devices;

each of said button replacement devices comprising a base member and a connecting member joined to said base member;

each said base member having an adhesive layer and a removable cover positioned over said adhesive layer; and each said connecting member being sized to pass through a button hole.

25. A kit according to claim 24, wherein each said base member has a surface containing a hook/loop system for connecting said base member to a free end of said connecting member.

26. A kit according to claim 24, further comprising a container for holding said button replacement devices.

* * * * *